US008381474B2

(12) United States Patent
Lewis

(10) Patent No.: US 8,381,474 B2
(45) Date of Patent: Feb. 26, 2013

(54) DRYWALL REPAIR KIT

(76) Inventor: James Lewis, Uwchland, PA (US)

( * ) Notice: Subject to any disclaimer, the term of this patent is extended or adjusted under 35 U.S.C. 154(b) by 0 days.

(21) Appl. No.: 12/851,259

(22) Filed: Aug. 5, 2010

(65) Prior Publication Data

US 2012/0031033 A1 Feb. 9, 2012

(51) Int. Cl.
*E02D 37/00* (2006.01)

(52) U.S. Cl. ..... 52/514; 52/746.1

(58) Field of Classification Search ..... 52/746.1, 52/742.1, 742.12, 514, 514.5; 156/280, 71, 156/41.7, 94; 428/41.7, 41.8, 63, 101, 130, 428/131, 138, 343, 354, 355 RA; 206/223, 206/582

See application file for complete search history.

(56) References Cited

U.S. PATENT DOCUMENTS

| | | | | | |
|---|---|---|---|---|---|
| 2,596,179 | A | * | 5/1952 | Seymour | 206/447 |
| 4,135,017 | A | * | 1/1979 | Hoffmann, Sr. | 428/78 |
| 4,460,420 | A | | 7/1984 | Estrada | |
| 4,761,319 | A | | 8/1988 | Kraus et al. | |
| 4,776,906 | A | * | 10/1988 | Bernard | 156/85 |
| 5,269,861 | A | | 12/1993 | Gilbreath | |
| 5,640,820 | A | | 6/1997 | Wood | |
| 5,687,528 | A | * | 11/1997 | Rouch | 52/514 |
| 6,162,525 | A | * | 12/2000 | Amy | 428/119 |
| 6,231,949 | B1 | * | 5/2001 | Hoffmann, Sr. | 428/139 |
| 6,268,563 | B1 | | 7/2001 | Gretz | |
| 6,627,292 | B1 | | 9/2003 | Hoffmann, Sr. | |
| 7,303,802 | B1 | | 12/2007 | Brower et al. | |
| 7,316,835 | B1 | * | 1/2008 | Swanson | 428/63 |
| 7,380,382 | B2 | * | 6/2008 | Hansen | 52/514 |
| 8,021,505 | B2 | * | 9/2011 | Lewis | 156/71 |
| 2002/0102381 | A1 | | 8/2002 | McClurg | |
| 2003/0228438 | A1 | | 12/2003 | Fleck et al. | |
| 2006/0191237 | A1 | | 8/2006 | Hansen | |
| 2008/0116087 | A1 | * | 5/2008 | Hathaway | 206/223 |

* cited by examiner

*Primary Examiner* — Jessica Laux
(74) *Attorney, Agent, or Firm* — Gregory J. Gore

(57) ABSTRACT

A surface repair kit includes an air-permeable breathable membrane coated with a premeasured amount of joint compound in its wet state. The membrane is suspended in a semi-rigid flexible frame and an opposing cover sheet is affixed over the compound around the backside of the frame. This framed composition is encased in an airtight package to prevent the compound from hardening. Included in the packaging may be a wall patch with an adhesive surface that holds a peel-off covering. Sandpaper may also be included in the kits since some repairs may require a final light sanding. The outside of the packaging carries simple printed instructions for the user to carry out the steps of peel, press and roll with accompanying illustrations so that drywall repairs can be carried out even by an unskilled novice.

19 Claims, 10 Drawing Sheets

FIG.9
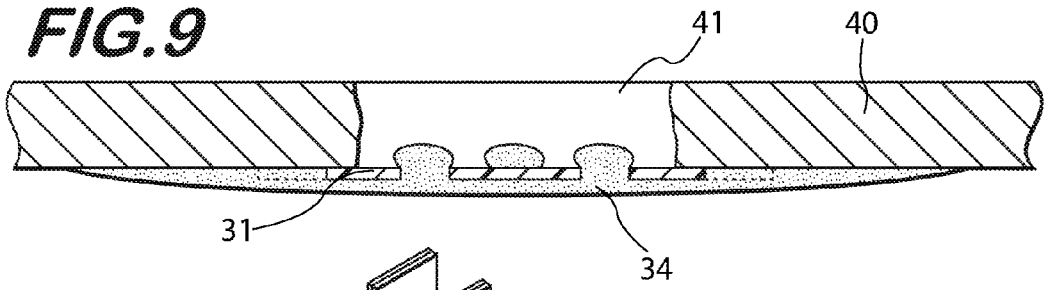
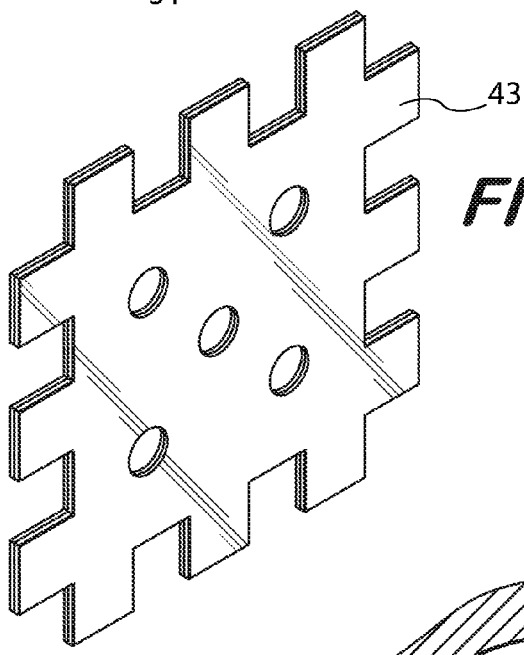
FIG.10
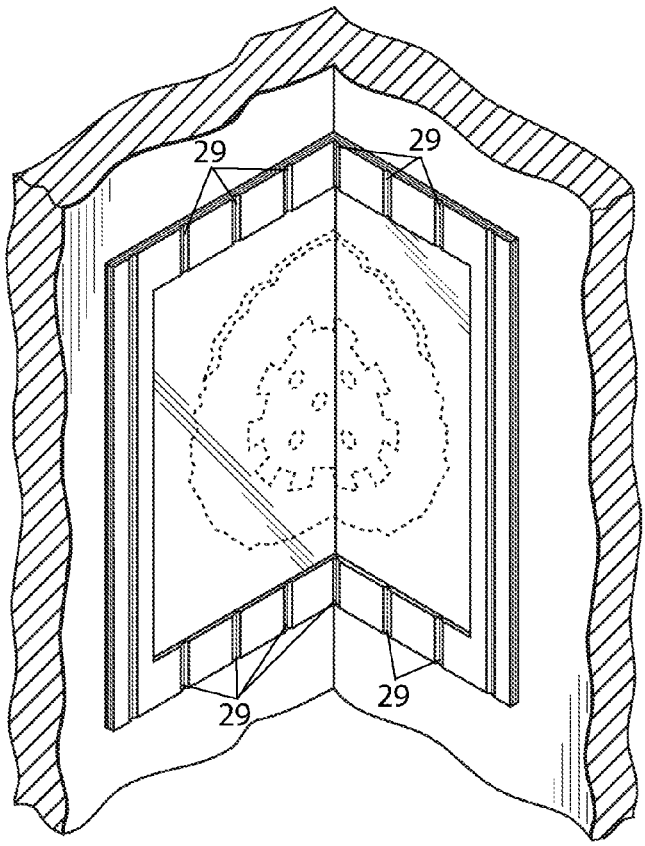
FIG.11

DRYWALL REPAIR KIT

FIELD OF THE INVENTION

The invention relates to wall and ceiling surface repair and materials. In particular, it relates to a repair patch for plaster or drywall surfaces which includes a patch and settable joint compound.

BACKGROUND OF THE INVENTION AND PRIOR ART

There are known various surface wall or ceiling surface repair systems that utilize a patch. These patching systems, however, require the handling of sticky, messy drywall compound and specialized knowledge and tools. Compound is measured, mixed, scooped and troweled over the patch and dries to a hardened surface, then it can be sanded smooth and flush with the surrounding wall. U.S. Patent Publication 2006/0191237, titled Drywall Repair Patch, discloses a repair patch which is pre-coated with a dry, water-hardenable cement product attached to one side of a porous substrate. While this joint repair compound is delivered with the patch substrate in place, it must be wetted and troweled smooth in the same manner as the commonly used tape and compound system. Therefore, this patch does not avoid direct contact with the messy and sticky joint compound and requires special troweling tools. Other prior art of which the Applicant is aware includes U.S. Pat. No. 6,162,525 entitled Drywall Patch issued to Amy, U.S. Pat. No. 5,269,861 entitled Structure and Method for Repair of Sheetrock Walls issued to Gilbreath and U.S. Patent Application Publication No. 2002/0102381 entitled Drywall Patch and Method issued to McClurg. However, none of these drywall repair systems anticipate or render obvious the Applicant's drywall repair kit which provides a no-touch system of applying joint compound and which does not require expertise or special tools.

SUMMARY OF THE INVENTION

In order to meet the needs in the art described above, the present drywall repair kit has been devised. In its general form, one embodiment of the invention provides a novel method of applying, spreading and drying a wet, settable compound such as drywall joint compound. The applicant has found that by applying a flexible, breathable membrane sheet against the settable compound and then pressing the membrane sheet forcibly against the application surface such as a wall or a ceiling with the compound in between, a no-touch system of applying the compound can be achieved. This system provides a clean, mess-free surface with contour protection while drying. Once dry, the membrane is peeled away from the compound. A translucent sheet of microporous "breathable" polyethelene or polypropylene membrane, such as MicroPro™ breathable plastic film sold by Clopay Corporation, 8585 Duke Boulevard, Mason, Ohio 45040, has been found to be particularly advantageous for applying and drying the compound. According to one embodiment of the invention, the air-permeable breathable membrane is coated with a pre-measured amount of joint compound in its wet state, making it immediately available for application to a wall surface. The membrane is suspended in a semi-rigid flexible frame which aids in ease and convenience of handling. An opposing cover sheet is affixed over the compound around the outside edges of the membrane by a peel away adhesive on the back of the membrane thus sandwiching the compound between the cover sheet and the membrane. Once the cover sheet is removed exposing the compound, the membrane adhesive remains active so that the frame will stick to the wall surface around the repair area.

Any smoothing device, such as a roller or straight-edge or even the user's hand, may be used to apply the smoothing pressure to spread the compound. If a translucent material is used for the membrane, the progress of the spreading of the compound can be observed as pressure is applied in different amounts and in different directions. After the compound has been applied smoothly and evenly across both the dry-patch surface and the surrounding application surfaces, the joint compound is then left to dry in the usual manner, and once dry, the framed membrane is then peeled away and discarded. As a final step in the smoothing process, a damp sponge or a light sandpaper may be used to feather the edges of the compound to provide a continuous surface over the repaired area. After the repair is completed, the remaining elements of the kit may be disposed of since the next repair can utilize another kit that will again have all materials necessary to effect a completed repair.

As delivered to the end user, this frame composition is encased in an airtight package to prevent the compound from hardening. Included in the packaging may be a wall patch with an adhesive surface that includes a peel-away covering. Sandpaper may also be included since some repairs may require final light sanding. The outside of the packaging has simple printed instructions for the user to carry out the steps of peel, press and roll with accompanying illustrations so that drywall repairs can be carried out even by an unskilled novice. The package therefore contains a complete repair kit.

Thus, it will be fully appreciated that the invention provides a no-touch wall repair system which is easy to use, requires no special tools or expertise, keeps waste material to a minimum and is easily disposable. While the aforementioned repair system is convenient for small cracks and holes in walls or ceilings of wallboard and plastered surfaces, an alternate embodiment of the invention provides a system for repairing larger or longer cracks or for covering access holes cut into the wall board. This alternate system is similar in concept to the system described above except that the patch includes a plug which matches the wall board hole. The frame includes grooves that add flexibility to the frame so that it can be bent into or around corners or curved surfaces.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 9 is a top plan sectional view taken from FIG. 8 as shown in that Figure.

FIG. 10 is a top left front isometric view of an alternate wall patch.

FIG. 11 is a top front isometric view.

DESCRIPTION OF THE PREFERRED EMBODIMENT

Figure 1:
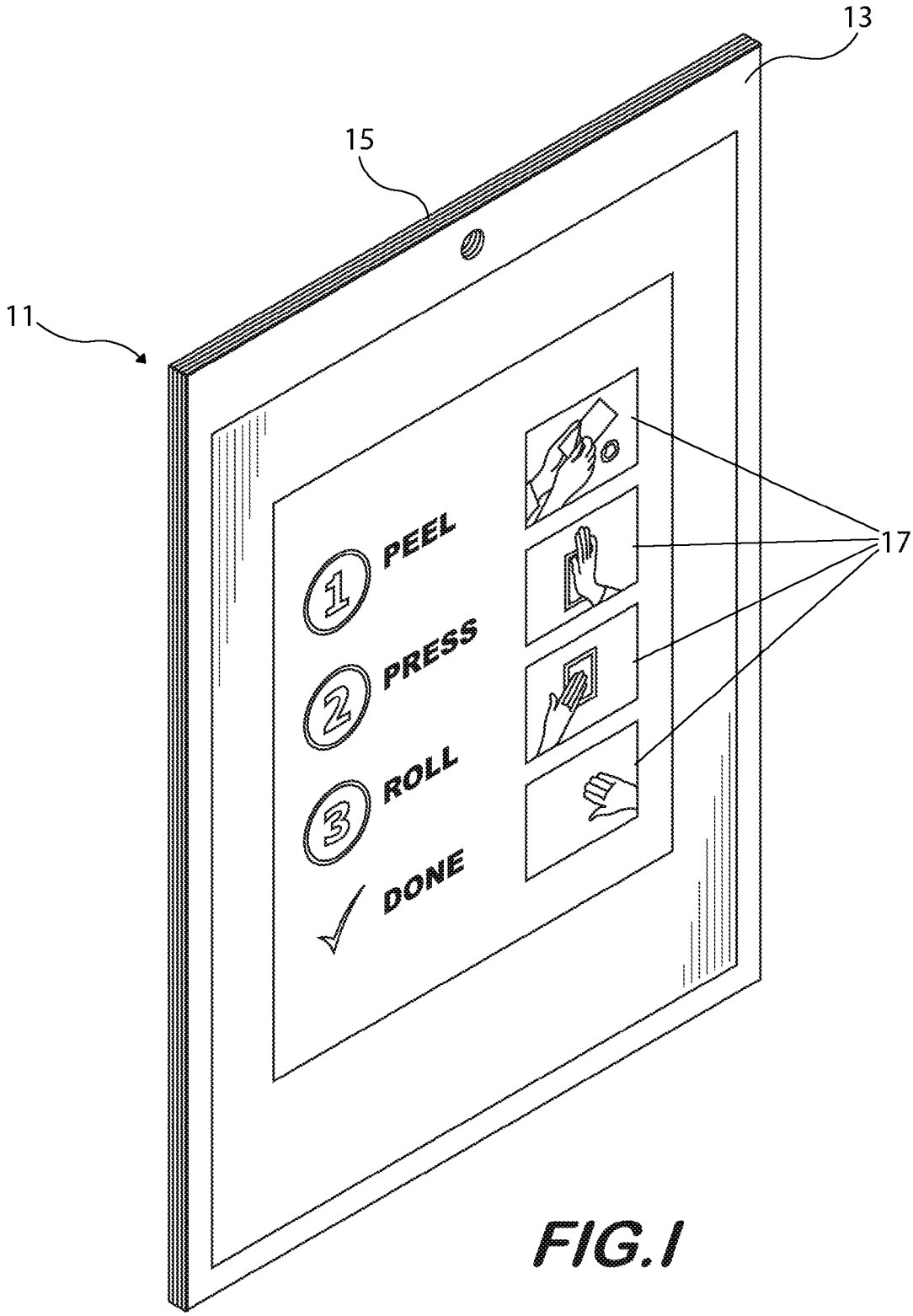
FIG. 1 is a top left front isometric view of the package containing the repair kit of the invention.

Referring now to FIG. 1, one embodiment of the invention comprises packaging 11 formed of front 13 and rear 15 panels bonded around their periphery to form a containment void between them to hold the various elements of the present wall repair kit described in more detail below. As shown in this Figure, the outside of the package includes written instructions for using the repair kit including illustrations 17 which depict its use.

Figure 2:
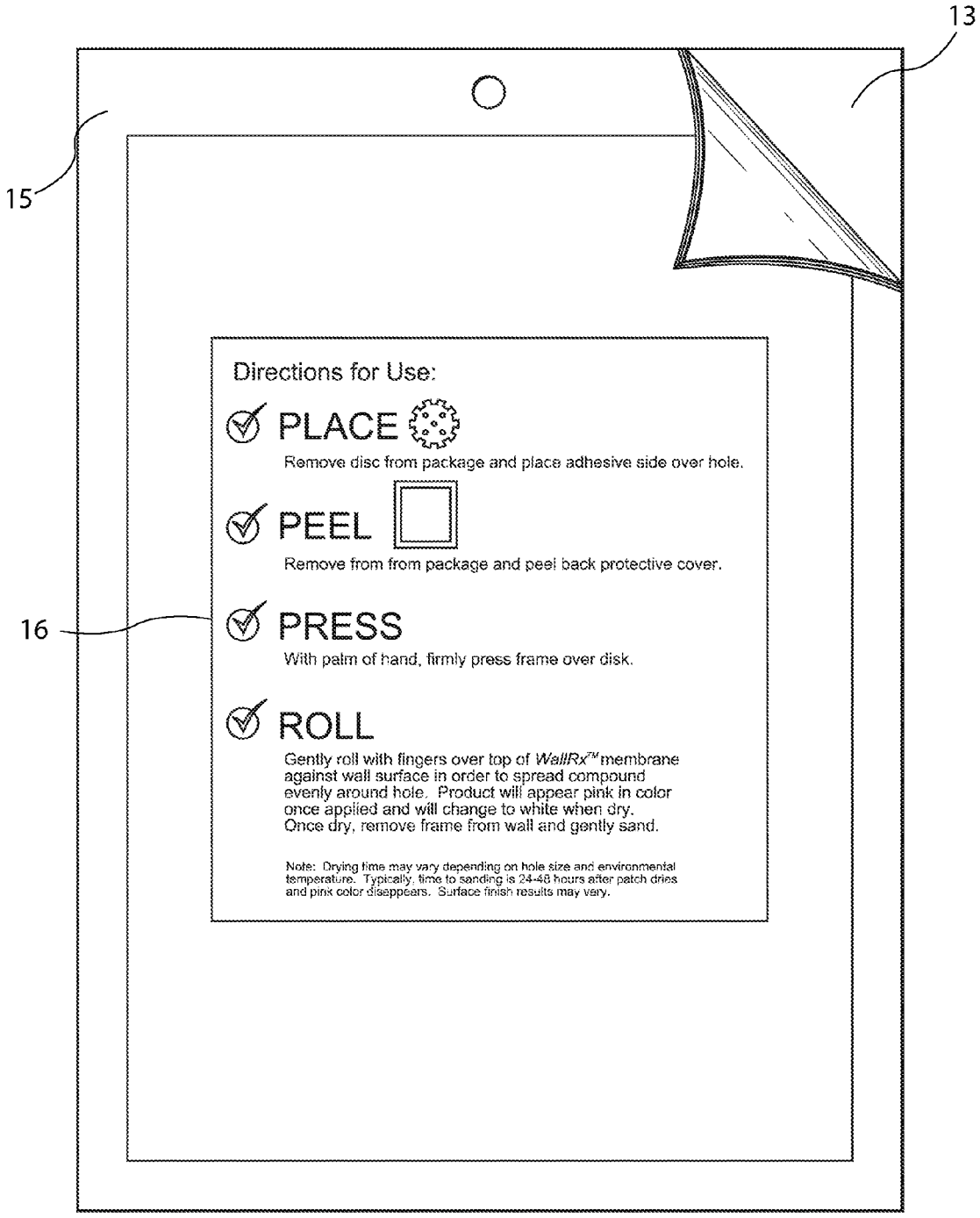
FIG. 2 is a rear elevation view of the repair kit package.

FIG. 2 is a rear view of the kit package shown in FIG. 1. The bonded packaging panels 13 and 15 may be manually separated to open the package as depicted in the top right corner of this figure. The bonding of the front and rear panels establishes an airtight package for the wet settable elements of the repair kit. In the depicted embodiment, the rear panel includes printed directions 16 for the place, peel, press and roll steps carrying out this embodiment of the invention in greater detail.

Figure 3:
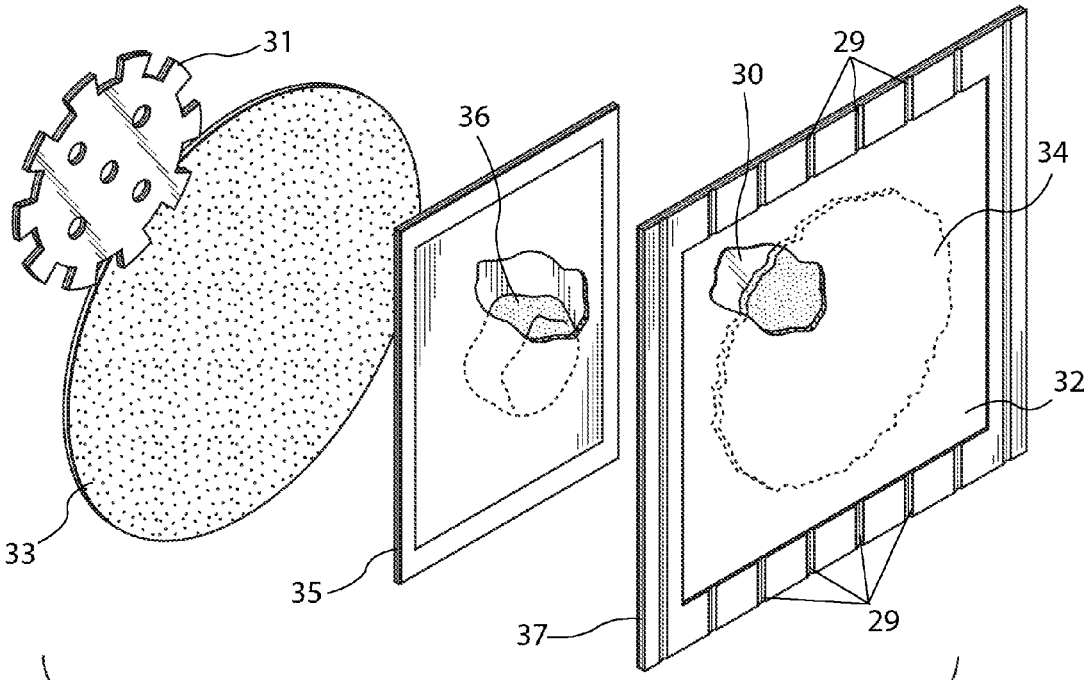
FIG. 3 is a top left front isometric view of the various components of the repair kit.
Figure 4:
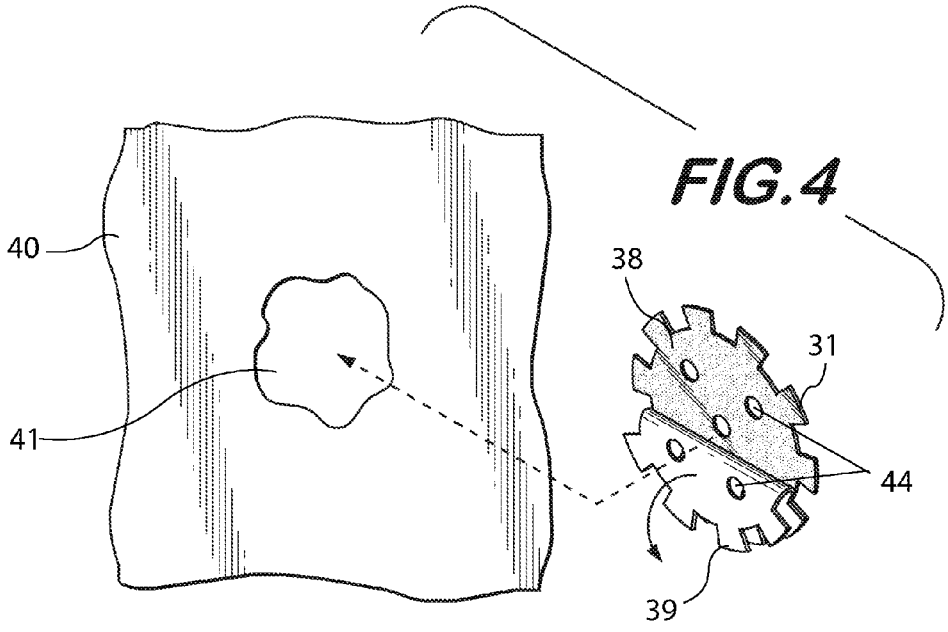
FIG. 4 is a top left rear isometric assembly view.
Figure 5:
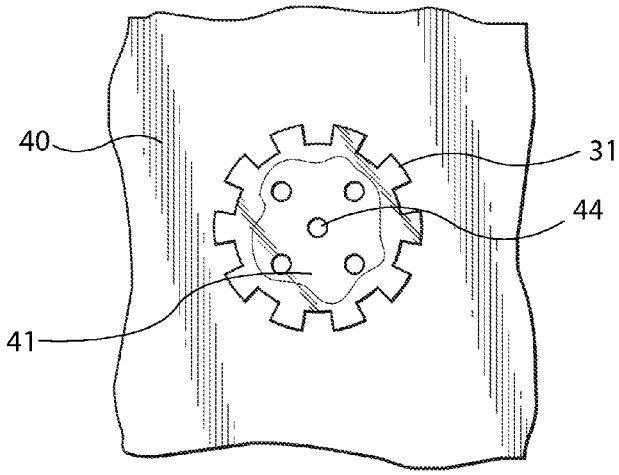
FIG. 5 is a front elevation view.

Referring now to FIG. 3, this embodiment of the repair kit includes a patch 31, a sanding disc 33, a packet 36 of additional wet settable repair compound and a framed quantity of compound 34 held suspended within a frame 37 between two flexible sheets, a breathable membrane 32 and a rear cover sheet 30. The frame 37 which is preferably made of plastic includes parallel grooves 29 which enable the frame to be folded or bent to conform to non-planar surfaces as further depicted in FIGS. 11-14. As depicted in FIG. 4, the patch 31 preferably includes an adhesive 38 applied to its backside which is protected and preserved by a peel-off backing 39. In this embodiment, the kit is shown applied to the surface of a wall 40 such as one composed of drywall wall board. The first step in the repair process is to apply the wall patch over the damaged area 41 of the wall 40 so that it is adhesively held in place as shown in FIG. 5. The patch is preferably perforated with holes 44.

Figure 6:
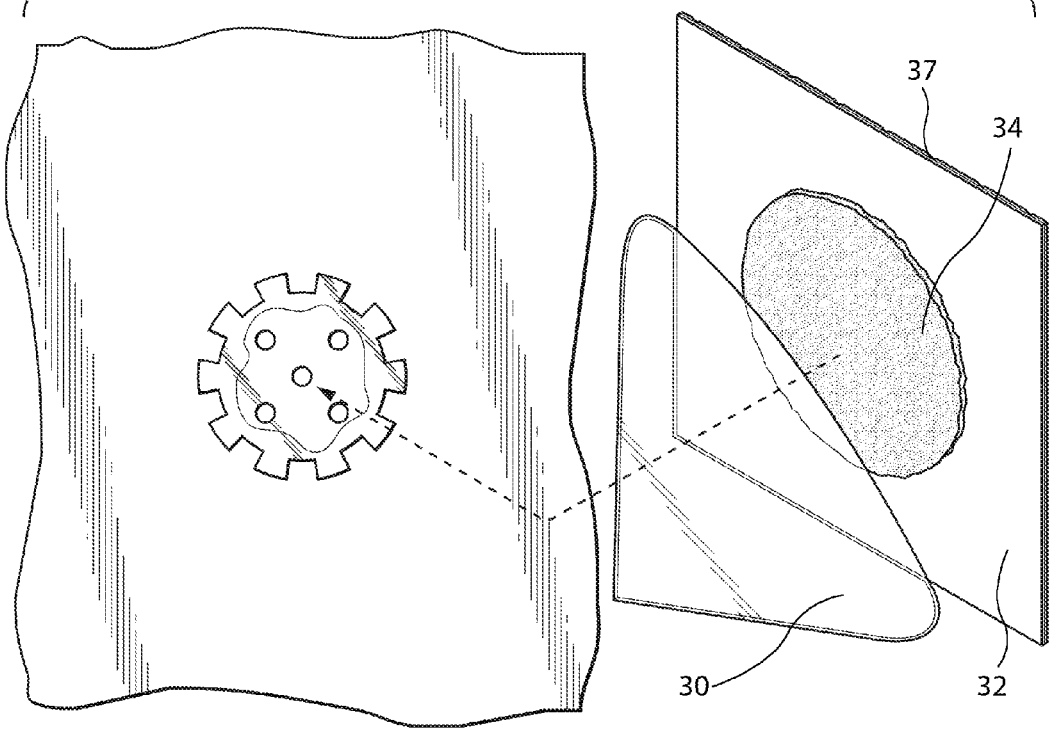
FIG. 6 is a top left rear isometric assembly view.

FIG. 6 depicts the next step in the process which includes removing a protective rear covering 30 which sandwiches a quantity of wet settable repair compound 34 against the back of the breathable membrane sheet 32 which in turn is adhesively affixed to a backside of the frame 37. The rear surface of the membrane includes an active adhesive preserved by the peel-off backing 30. When the cover sheet is removed, this adhesive secures the frame to the wall with an open area of the frame encompassing the wall damaged area and patch as shown in FIG. 7.

Figure 7:
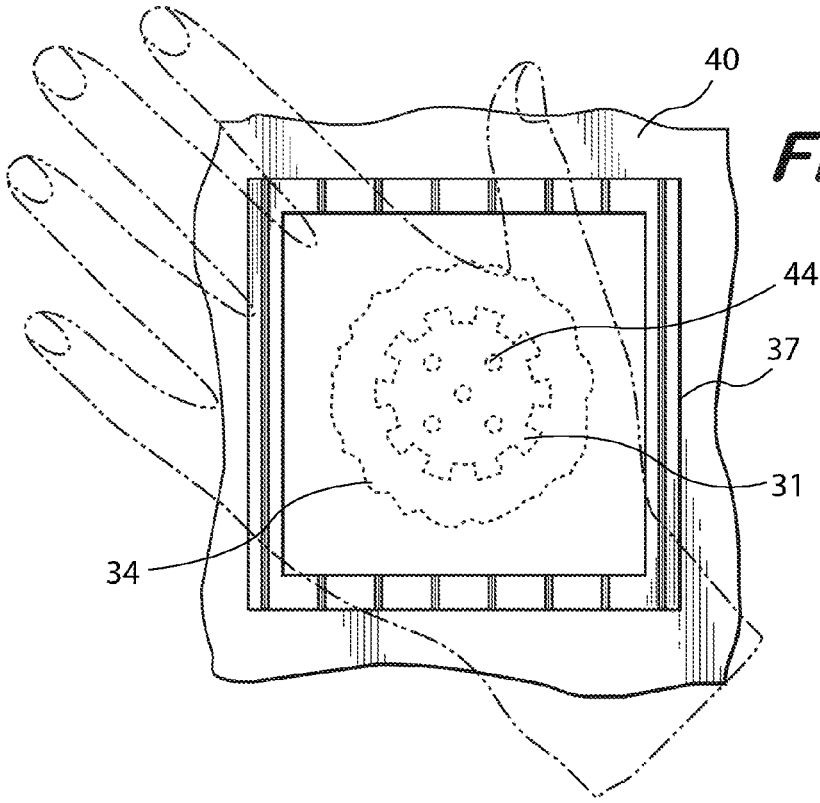
FIG. 7 is a front elevation view with the operator's hand shown in phantom
Figure 8:
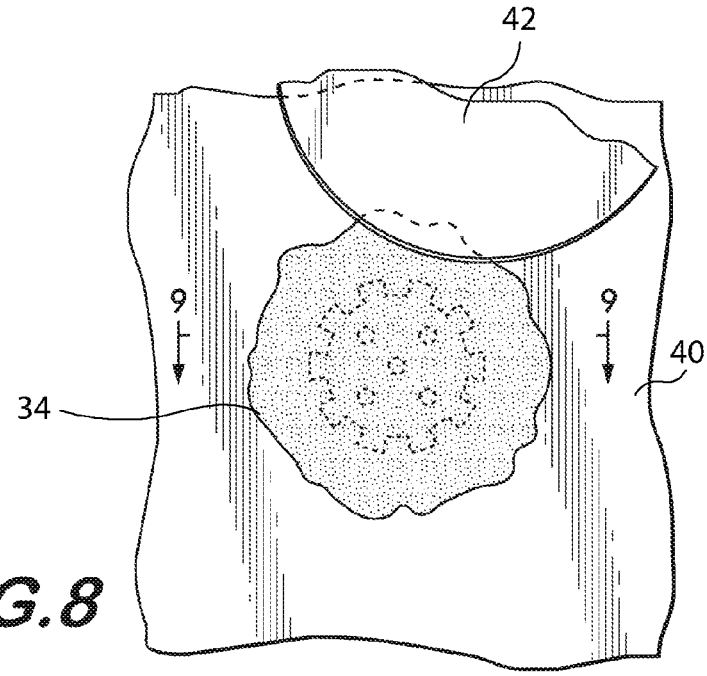
FIG. 8 is a front elevation view.

Referring now to FIG. 7, the next step in the process is to manually apply pressure to the breathable membrane to spread the compound 34 over the wall 40 and into holes 44 in the patch 31 with the frame 37 remaining adhesively affixed to the wall. The compound 34 is now allowed to dry as air in the surrounding environment penetrates the membrane 32 and permits moisture to be expelled from the compound 34. Once the compound is dry, the frame is removed revealing the compound spread evenly over the patched damaged area as shown in FIG. 8. The sanding disc 42 may now be used to feather the edges of the dried compound to achieve a smooth finish.

FIG. 9 shows the finished dried compound 34 covering the damaged area 41 of the wall 40. As seen in this Figure, some of the compound has passed through holes in the patch 31 interlocking the dried compound with the patch 31. FIG. 10 depicts an alternate embodiment of the patch 43 which has an overall square shape rather than round as depicted in the previous figures of drawings.

Figure 12:
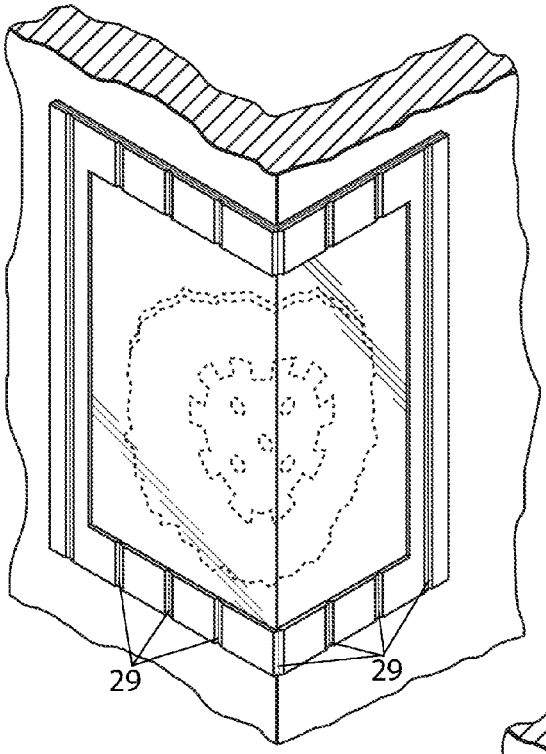
FIG. 12 is a top front isometric view.
Figure 13:
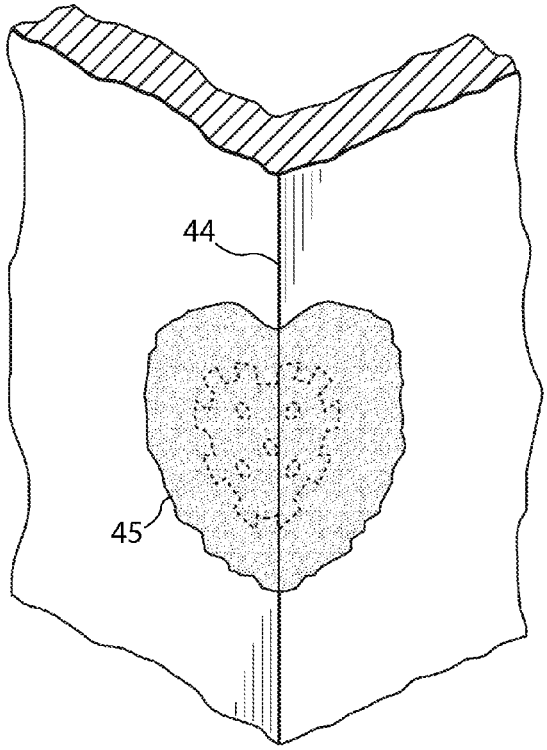
FIG. 13 is a top front isometric view.
Figure 14:
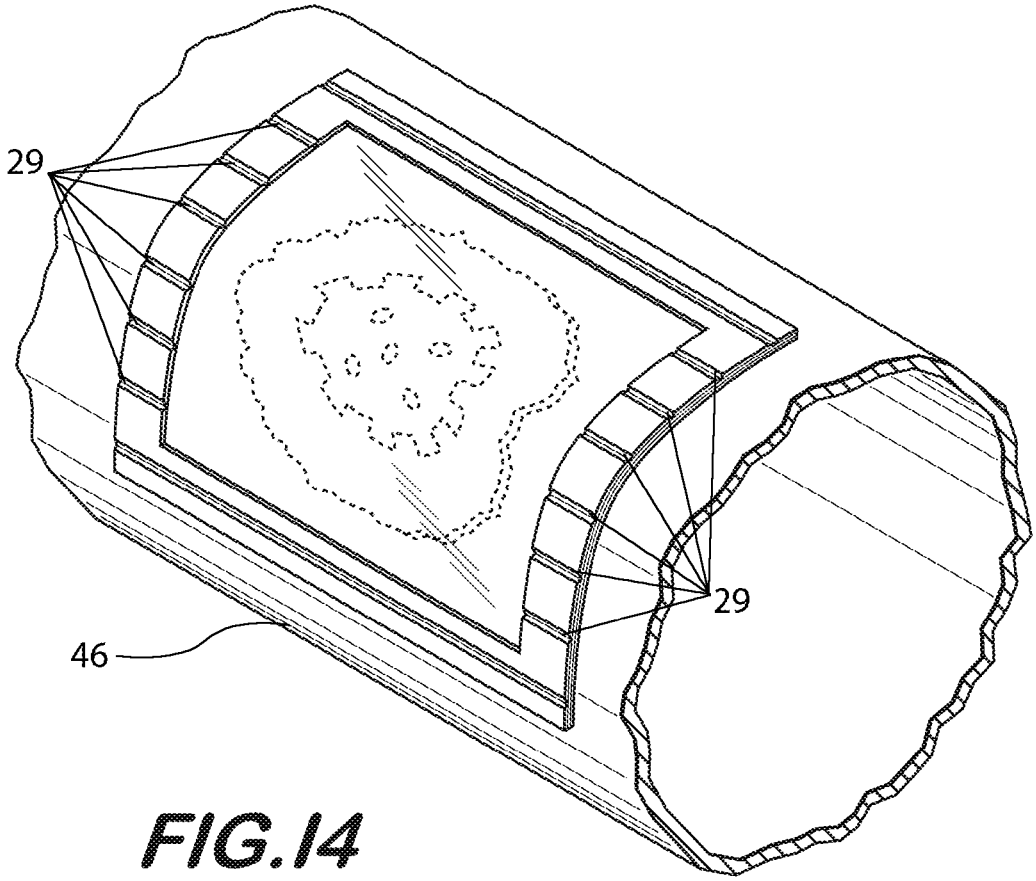
FIG. 14 is a top front left isometric view.

Referring now to FIGS. 11-14, the embodiment shown in FIG. 3 is shown applied to non-planar surfaces. The grooves 29 in the frame 37 which is preferably made of plastic provide lines of weakness to accommodate folding the frame about corners such as shown in FIGS. 11 and 12. FIG. 13 depicts the resulting repair 45 on the convex corner 44 of FIG. 12. FIG. 14 shows how the lines of weakness can add flexibility to the frame so that it may be bent to conform to the contour of curved surfaces such as the cylindrical pipe 46 shown in this Figure.

Figure 15:
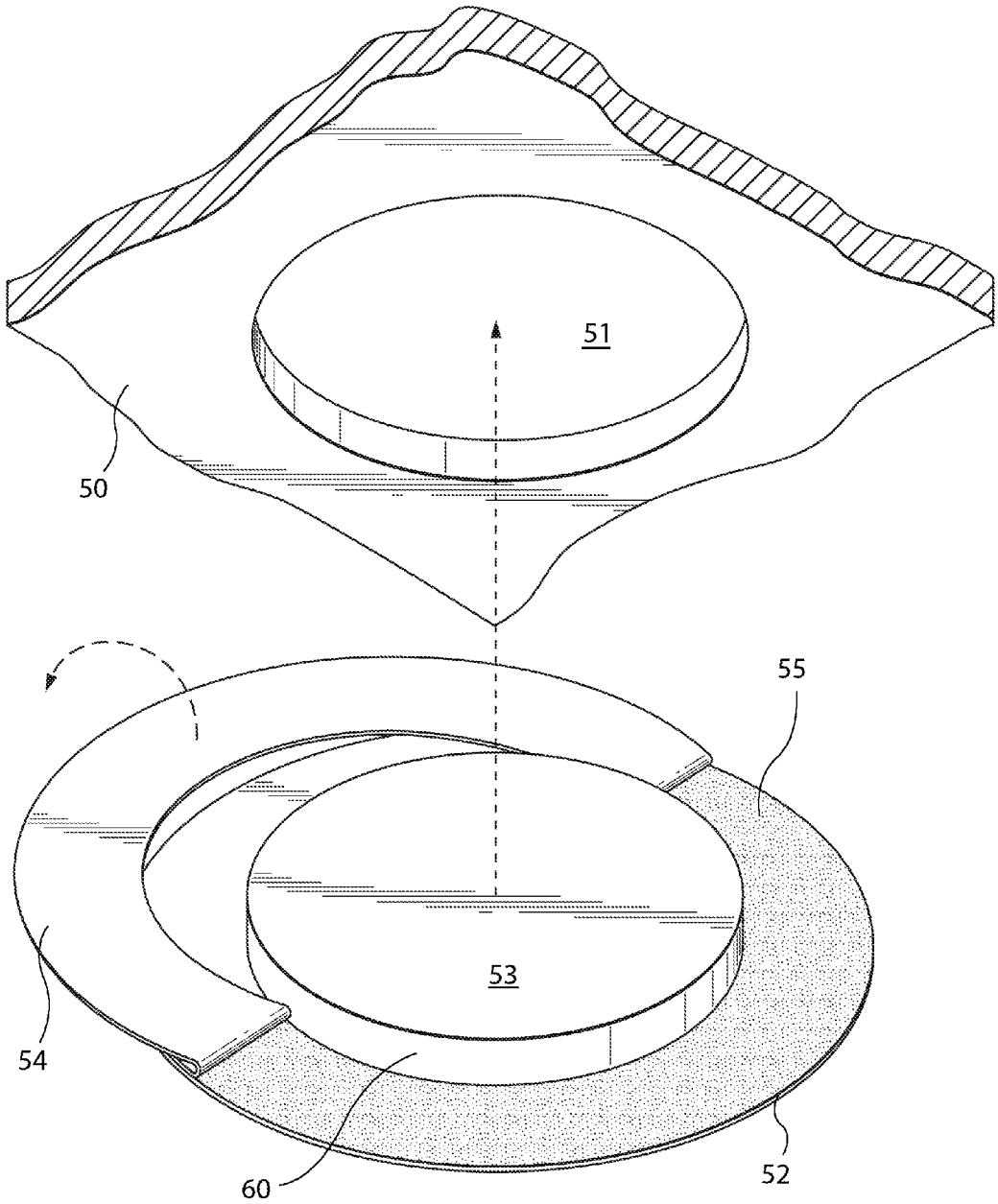
FIG. 15 is a top front isometric assembly view.
Figure 16:
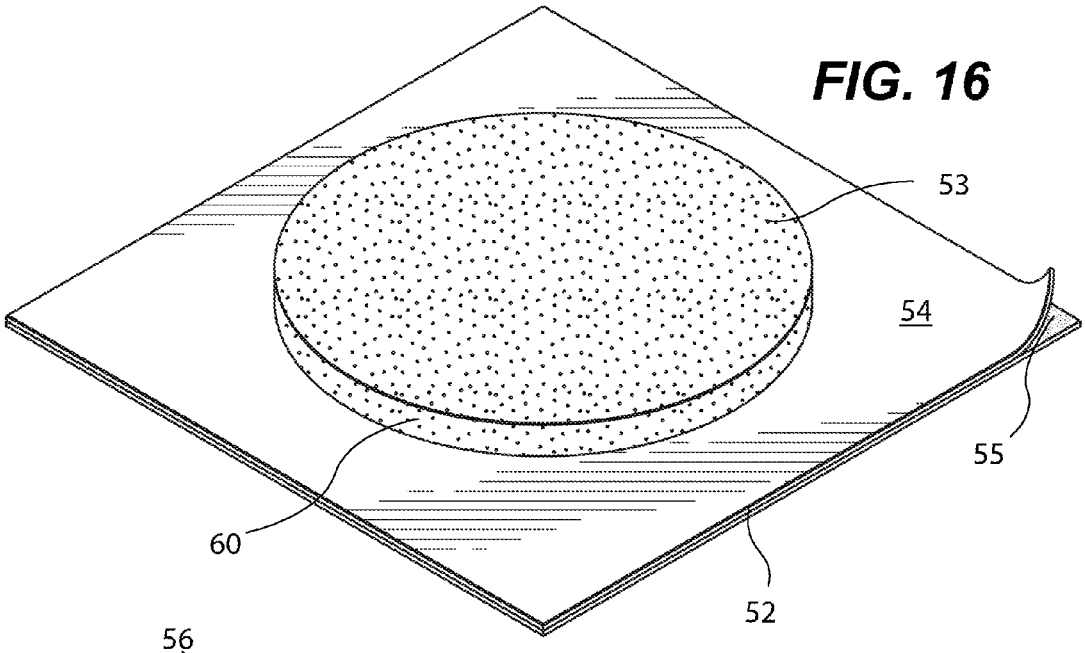
FIG. 16 is a top left front isometric view.
Figure 17:
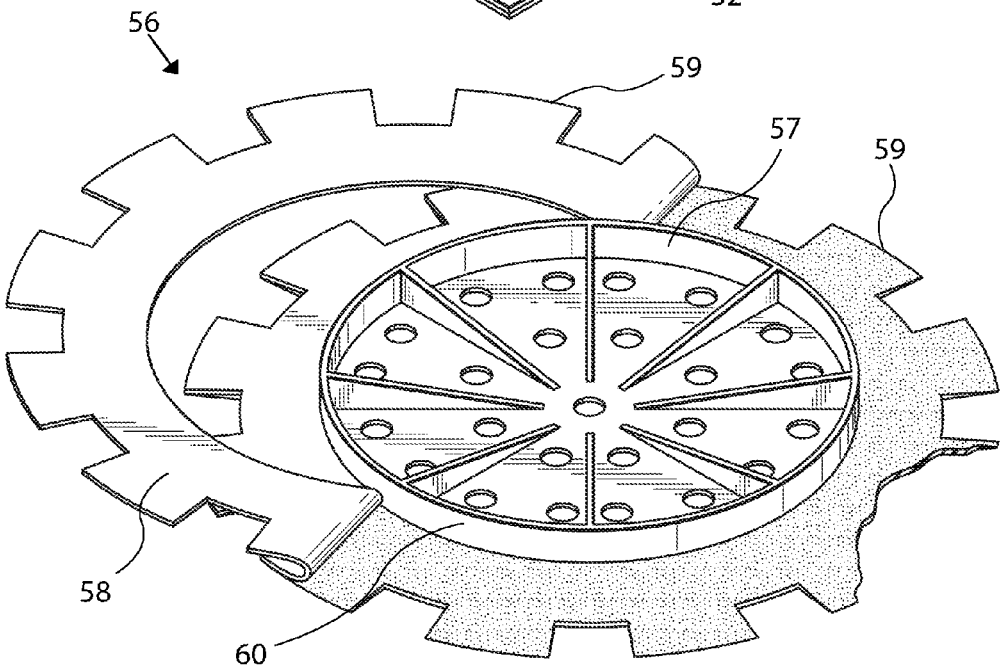
FIG. 17 is a top rear isometric view.

FIGS. 15, 16 and 17 show different embodiments of specialized patches designed to match and plug a pre-cut hole in wall board 50 such as a circular hole 51 as shown in FIG. 11. In the embodiments shown in FIGS. 15 and 16, the patch includes a front sheet 52 to which different types of circular plugs 53 have been affixed. In both embodiments, a peel-off backing 54 preserves adhesive 55 on the back of the sheet so that it remains active when applied to the wall board. The front sheet is always larger than the plug so that it spans the seam between the plug and the wall board hole. The plugs shown in FIGS. 15-17 all include cylindrical sides 60 which are slightly tapered to provide a snug press-fit between the plug and the wall board. The embodiment in FIG. 16 depicts a square front sheet 52 which carries a circular plug 53 composed of molded foam. The embodiment shown in FIG. 17 depicts a one-piece molded plastic plug 56 having a circular flange 58 and a cup-shaped plug 57 which has perforations that provide interlocking engagement with the repair compound once it has set. This embodiment also includes a plurality of radially extending tabs 59 which also aid in securing the plug to the wall board.

Thus it may be appreciated to those of skill in the art that the advantages of the invention have been achieved from the embodiments of the preferred invention shown. Also, it should be understood that there may be other modifications and changes to the present invention that will be obvious to those of skill in the art from the foregoing description, however, the present invention should be limited only by the following claims and their legal equivalents.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is:

1. A surface repair kit comprising:

a semi-rigid planar frame having a front, a back and sides which border and enclose a co-planar central open area, said open area being sized to fully encompass a damaged area of said surface;

a flexible air-permeable micro-porous membrane affixed to the back of said frame covering the entirety of said open area;

a quantity of wet settable compound coating a rear surface of said membrane and lying only within a boundary of said open area defined by said frame; and a cover sheet lying against the compound sandwiching said compound between the cover sheet and the membrane, said membrane impermeably retaining said compound and being releasable from the compound after it has dried.

2. The repair kit of claim 1 wherein the perimeter of a rear surface of the membrane includes a peel-off adhesive such that said cover sheet may be peeled off leaving said membrane adhesive active for releasably affixing said frame to said surface around but not covering the damaged area to be repaired.

3. The repair kit of claim 2 contained within an airtight packaging.

4. The repair kit of claim 3 further including a wall patch.

5. The repair kit of claim 4 wherein said wall patch includes a peel-off adhesive backing secured to a back side of said patch.

6. The repair kit of claim 5 wherein said patch is perforated with holes for receiving said compound.

7. The repair kit of claim 6 wherein said patch comprises a planar sheet of material having a plurality of tabs extending from side edges thereof.

8. The repair kit of claim 7 wherein said frame is composed of plastic.

9. The repair kit of claim 8 wherein said membrane is substantially coextensive with outer edges of said frame.

10. The repair kit of claim 4 further including a sheet of sandpaper.

11. The repair kit of claim 4 wherein the outside of the package includes printed directions for repairing damaged drywall using said kit and illustrations showing steps in the method of its use.

12. The repair kit of claim 5 wherein said patch further includes a cup-shaped circular plug with tapered side surfaces.

13. The repair kit of claim 5 wherein said patch further includes a substantially cylindrical plug adhesively affixed to a rear surface of said patch wherein said plug is composed of molded compressible foam.

14. The repair kit of claim 7 wherein said surface is a wall composed of drywall wall board.

15. The repair kit of claim 1 wherein said frame includes a plurality of grooves lying along the surface in selected areas which provide lines of weakness to increase the flexibility of the frame in those areas.

16. The repair kit of claim 15 wherein said plurality of grooves are parallel.

17. The method of repairing a damaged area of a wall comprising the steps of:

adhesively affixing a semi-rigid frame to the wall which establishes a boundary around an area of wall damage, said frame holding a quantity of wet settable repair compound against the wall within an open area of said frame on a back side of an air-permeable breathable membrane affixed to said frame;

applying manual pressure to a front surface of said membrane within said open area whereby said compound is spread between said membrane and said wall over the damaged area to be repaired;

allowing sufficient time for said compound to dry; and removing said frame and said membrane from said wall and said compound.

18. The method of claim 17 further including the final step of sanding said compound.

19. The method of claim 18 beginning with a first step of affixing a patch to said wall covering the damaged area.

* * * * *